US006634902B1

(12) United States Patent
Pirovic

(10) Patent No.: US 6,634,902 B1
(45) Date of Patent: Oct. 21, 2003

(54) PURIFICATION LAMP CONNECTOR

(75) Inventor: Arpad L. Pirovic, Woodbridge, CT (US)

(73) Assignee: Light Sources, Inc., Orange, CT (US)

( * ) Notice: Subject to any disclaimer, the term of this patent is extended or adjusted under 35 U.S.C. 154(b) by 0 days.

(21) Appl. No.: 10/150,395

(22) Filed: May 17, 2002

(51) Int. Cl.[7] ..... H01R 13/625
(52) U.S. Cl. ..... 439/337; 439/241; 439/700
(58) Field of Search ..... 439/336, 700, 439/332, 335, 699.2, 337, 241, 240

(56) References Cited

U.S. PATENT DOCUMENTS

| | | | | |
|---|---|---|---|---|
| 2,280,747 A | | 4/1942 | Burt | |
| 2,288,376 A | | 6/1942 | Tuppen | |
| 2,333,082 A | | 11/1943 | Chirelstein | |
| 3,359,414 A | | 12/1967 | Ege | |
| 4,084,873 A | | 4/1978 | Grate | |
| 4,275,325 A | | 6/1981 | Guim | |
| 4,936,789 A | | 6/1990 | Ugalde | |
| 4,994,710 A | | 2/1991 | Roelevink et al. | |
| 5,030,125 A | | 7/1991 | Toma et al. | |
| 5,540,848 A | | 7/1996 | Engelhard | |
| 5,542,857 A | | 8/1996 | Hume et al. | |
| 5,634,820 A | | 6/1997 | Vakil | |
| 5,904,415 A | | 5/1999 | Robertson et al. | |
| 6,010,350 A | * | 1/2000 | Henrici et al. | 439/337 |
| 6,039,460 A | | 3/2000 | Ng et al. | |
| 6,045,387 A | * | 4/2000 | Papini | 439/337 |

* cited by examiner

*Primary Examiner*—Gary Paumen

(57) ABSTRACT

A first pair of axially extending terminals on a high voltage insulation plug designed to mount on an end of a gas discharge lamp are separated from each other by a wall that carries a second pair of axially extending terminals mounted on the wall spaced axially from the first pair, the four terminals are adapted for electrical connection to the gas discharge lamp; and a high voltage insulation socket having four axial passageways each containing an axially movable contact spring biased toward the plug, the terminals and passageways so configured that when the plug is rotated on the socket about a common axis with each terminal axially depressing one of the contacts, protrusions on the second pair can be rotated under shoulders in the socket adjacent to the passageways.

10 Claims, 5 Drawing Sheets

PURIFICATION LAMP CONNECTOR

BACKGROUND OF THE INVENTION

1. Field of the Invention

In a water purification treatment, water is flowed through a vessel around a plurality of parallel ultraviolet transparent tubes. Each tube contains a mercury vapor lamp which emits bacteria destroying ultraviolet radiation.

This invention pertains to liquid purification lamps, more particularly to a connector assembly designed for electrically connecting to a mercury vapor ultraviolet lamp and for removing the lamp from a tube of a water treatment tank.

2. Description of the Prior Art

U.S. Pat. No. 5,030,125, patented Jul. 9, 1991 by Toma et al., describes an elongated cylindrical ultraviolet lamp envelope positioned in an ultraviolet transparent elongated quartz cylindrical tube that extends the length of a cylindrical casing of a water treatment unit. The envelope terminates in a conventional electrical pin at each end of the envelope.

At one end of the envelope, a terminal at the end of a wire lead engages the electrical pin. The wire lead extends through an elastic boot or cap that extends a short distance, cylindrically, sealingly, between the lamp envelope and the quartz tube. A threaded retainer cap contacts the elastic boot axially and is threaded onto an O-ring sealing collar that surrounds the end of the quartz tube, so that the retainer cap prevents axial movement of the lamp and the elastic boot cylindrical seal out of the quartz tube.

At the other end of the envelope, a similar terminal, boot and O-ring seal are mounted on the quartz tube. The threaded retainer cap at the other end further includes an axial spring inside the cap that bears against the boot, urging the boot and electrical pin that it contains, toward the end of the lamp envelope so that electrical contact between the pins and the electrical contacts at each end of the lamp envelope is maintained in spite of any vibrations occurring in the water treatment unit.

The lengths of the cylindrical casing, quartz tube, lamps and boot and terminal assemblies are so selected so as to leave a gap within the retainer cap between the boot and the O-ring sealing collar to allow for axial biasing.

U.S. Pat. No. 5,540,848, patented Jul. 30, 1996 by Engelhard, describes an ultraviolet water purification canister which includes an ultraviolet lamp envelope having parallel electrical pins extending from one end of the envelope. The lamp is mounted in an ultraviolet transparent quartz tube that is closed at one end. Mounting of the lamp in the tube is provided by the pin containing end of the lamp extending from the open end of the tube, the pins being plugged axially into a lamp energizer circuit box that is mounted in a removable base of the canister.

U.S. Pat. No. 6,039,460, patented Mar. 21, 2000 by Ng et al., describes a quartz tube or sleeve, liquid tight sealed to and spaced from a threaded collar on a mounting plate of a water purification tank wall by a compression nut and 0-ring on the collar, through which the tube extends into the tank. An elongated cylindrical ultraviolet lamp that extends into the tube is held parallel to and spaced from the cylindrical wall of the tube by lock tabs that extend radially from an end cap of the tube which are axially inserted into upwardly open lobes in the compression nut and threaded ¼turn down into the end of the compression nut when the lamp is inserted into the nut and turned ¼turn. A terminal connector button having metal lined axial apertures for receiving axial terminal pins that extend from an end of the ultraviolet lamp is mounted on the lamp pins and is captured on the end of the lamp and on the end of the compression nut by a retainer cap that is screwed onto the compression nut and that bears on a radial annular shoulder that extends from the base of the button. The axial apertures in the button also receive wire for powering the lamp. The wire passes through a cover cap that screws onto the button.

SUMMARY OF THE INVENTION

It is one object of the invention to provide an electrical connector assembly for one end of an elongated lamp envelope or shell.

It is another object of the invention to provide a high voltage connector assembly for a gas discharge tube.

It is another object of the invention to provide a high voltage connector assembly for a low pressure mercury vapor gas discharge elongated cylindrical lamp envelope, that is designed to slip with the lamp envelope into an ultraviolet transparent tube in a water purification treatment tank.

It is another object of the invention that the high voltage connector assembly designed to slip with the lamp envelope into an ultraviolet transparent tube in a water purification tank contains a male plug that receives one end of the lamp envelope and is permanently fastened thereto, and a female socket that removably locks onto the male plug so that the lamp envelope and plug can be removed from the transparent tube by wires attached to the female socket.

A high voltage connector assembly for an ultraviolet lamp sealed gas discharge envelope includes a plug and a socket, the plug comprising:

a first electrically non conductive body comprising a front, a back and a first axis extending through the front and the back, a first opening in the front configured for receiving the first end of the envelope, a lateral first shoulder, spaced from the front of the first body, a first electrically conductive terminal post, extending backward axially from the first shoulder, spaced from the first axis, having a front end adapted for electrical connection to an electrical conductor of the gas discharge tube when the first end of the envelope is in the first opening, and a back end, a first wall extending backward axially from the first shoulder adjacent to and spaced from the first terminal post, a lateral second shoulder on the first wall, spaced back from the back end of the first terminal post, a second electrically conductive terminal post, extending axially from the second shoulder, spaced from the first axis and from the first post, having a front end adapted for electrical connection to an electrical conductor of the gas discharge tube when the first end of the envelope is in the opening, a back end, and a lateral protrusion on the back end of the second terminal post, the socket comprising:

a second electrically non conductive body comprising a front, a back and a second axis extending through the front and the back, a lateral third shoulder, spaced from the back of the second body, a second wall extending axially forward from the third shoulder, spaced from the second axis, a first passageway in the back of the second body extending axially through the third shoulder spaced from the second axis, a wall of the first passageway extending from the third shoulder in a groove in the second wall axially along the second wall, first electrical contact slidably mounted in the first passageway and the groove, first means in the first passageway for urging the first electrical contact toward the front of the second body, a second passageway in the back of the second body extending axially through the third shoulder, spaced from the second axis and from the first passageway, comprising a lateral fourth shoulder behind the third shoulder, a second electrical contact slidably mounted in the second passageway, second means in the second passageway for urging the second electrical contact toward the front of the second body;

the first terminal post, second terminal post, first passageway and second passageway being so configured that when the plug is placed on the socket with the first and second axes in alignment, the first post axially on and axially depressing the first electrical contact, the second post axially on and axially depressing the second electrical contact, the protrusion can be rotated around the first axis under the fourth shoulder.

BRIEF DESCRIPTION OF THE DRAWINGS

In order that the invention be more fully comprehended, it will now be described, by way of example, with reference to the accompanying drawings, in which.

DESCRIPTION OF THE PREFERRED EMBODIMENTS

Figure 1:
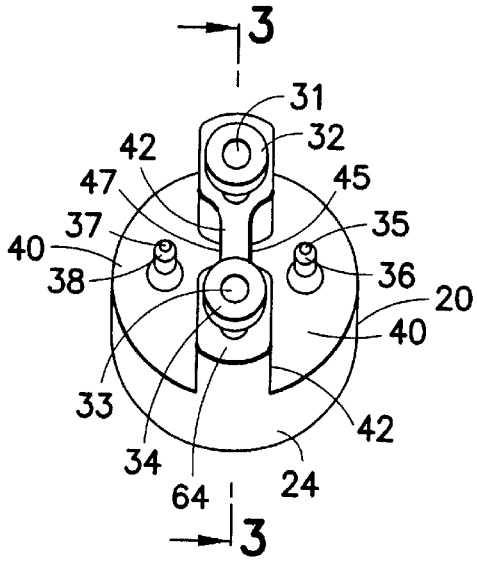
FIG. 1 is a top perspective view of the plug of the connector assembly.
Figure 2:
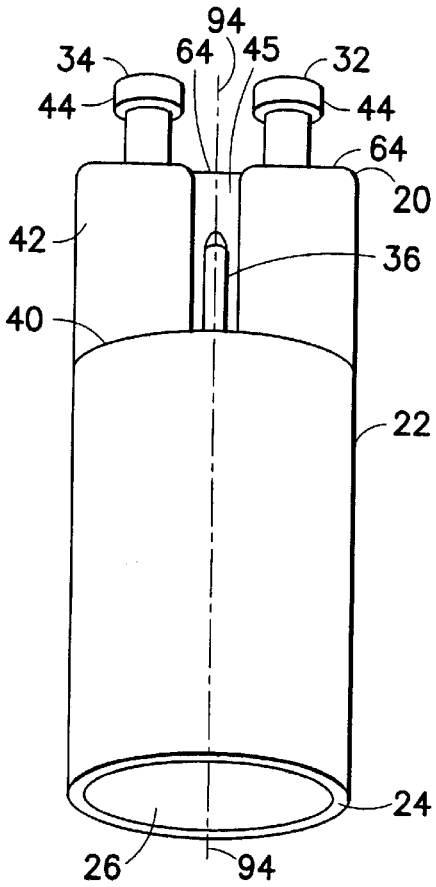
FIG. 2 is a side perspective view of the plug of FIG. 1.
Figure 3:
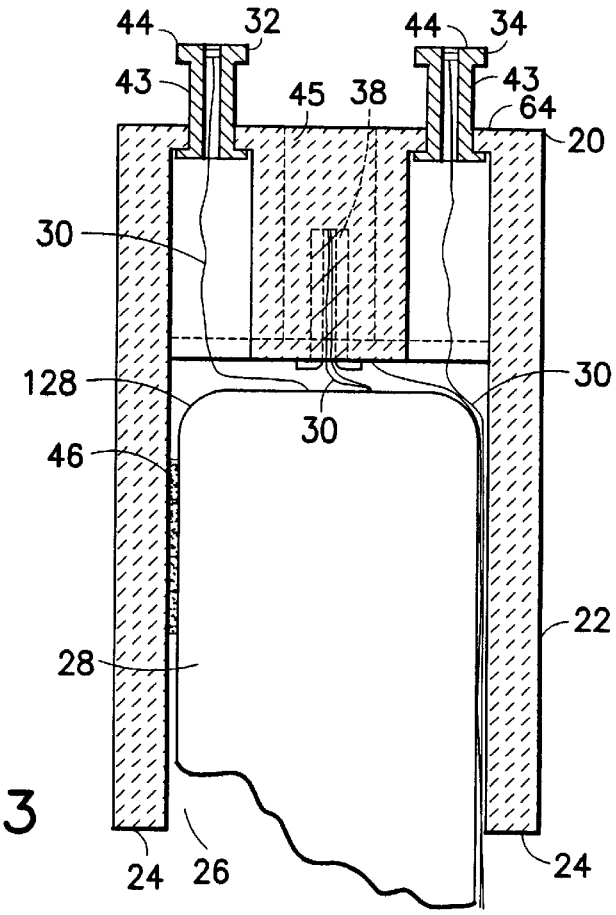
FIG. 3 is a cross section view of the plug of FIG. 1 taken along 3—3.
Figure 4:
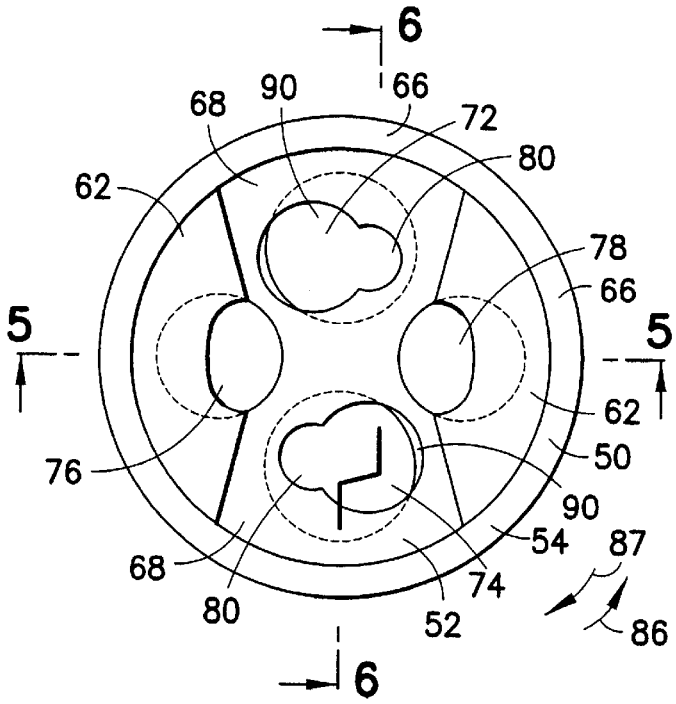
FIG. 4 is a top perspective view of the socket of the connector assembly.
Figure 5:
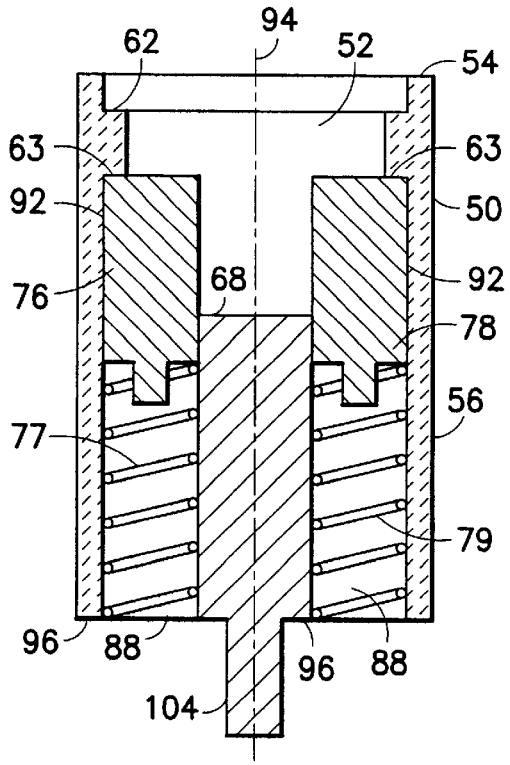
FIG. 5 is a cross section schematic view of the socket of FIG. 4 less the base of the socket, taken along 5—5.
Figure 7:
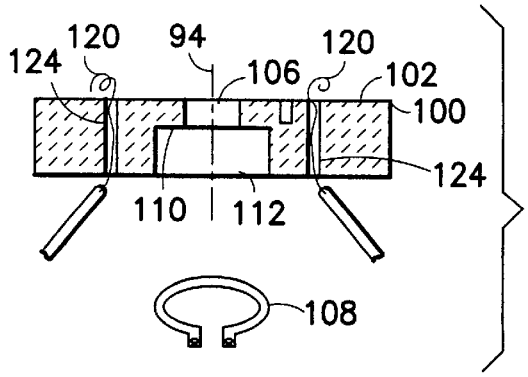
FIG. 7 is a cross section schematic view of the base of the socket of FIG. 5.
Figure 6:
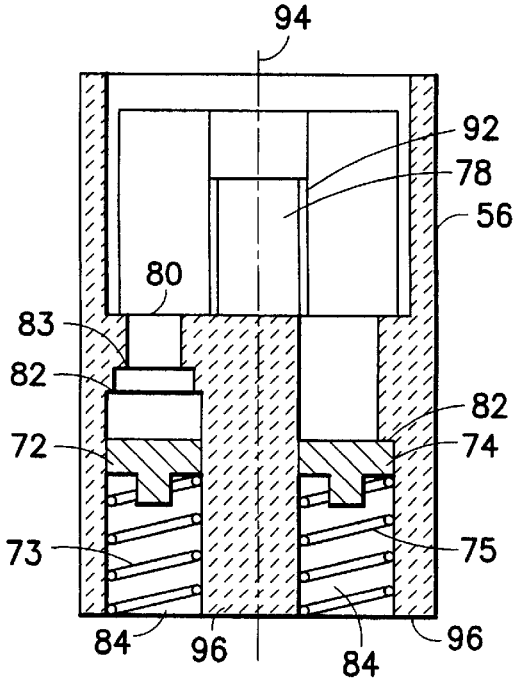
FIG. 6 is a cross section schematic view of the socket of FIG. 4 less the base of the socket, taken along 6—6.
Figure 8:
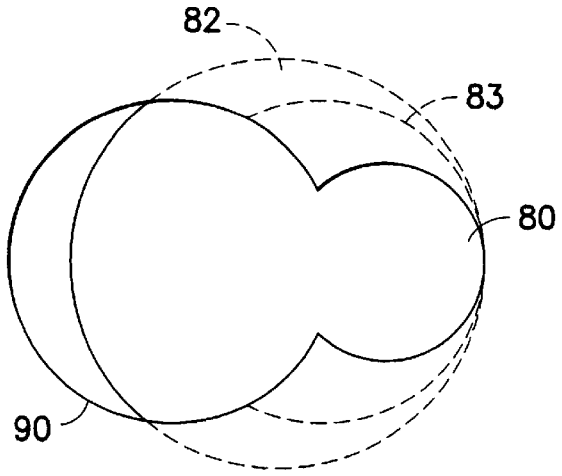
FIG. 8 is a top view of an opening for a spring loaded contact of the socket of FIG. 6.
Figure 9:
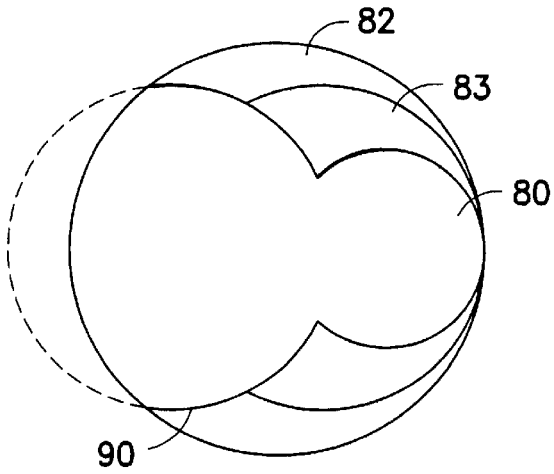
FIG. 9 is a bottom view of the opening of FIG. 8.

Before explaining the invention in detail, it is to be understood that the invention is not limited in its application to the detail of construction and arrangement of parts illustrated in the drawings since the invention is capable of other embodiments and of being practiced or carried out in various ways. It is also to be understood that the phraseology or terminology employed is for the purpose of description only and not of limitation.

Referring to FIGS. 1–3 and 10, ceramic shell 22 of plug 20 is designed to receive one end of a mercury vapor lamp 128 tubular quartz sealed gas discharge envelope 28 by way of opening 26 in end 24 of the shell.

Wires 30 which extend from the lamp envelope extend into holes 31, 33, 35, and 37 respectively of terminal posts 32, 34, 36, and 38 and are welded or soldered to the posts. The portion of envelope 28 that is within shell 22 is glued 46 to the shell.

Referring to FIGS. 1–10, ceramic socket 50 comprises body portion 56 which is designed to receive wall 42 that rises from shoulder 40 of plug 20, past end 54 into opening 52 between contacts 76, 78, which is inserted into end 54 until shoulder 40 rests against shoulder 62.

Upon insertion of wall 42 into opening 52 with radially extending annular hats 44 on shafts 43 of posts 32 and 34 lined up with slot openings 90, the hats enter openings 90, terminal posts 32, 34, 36, and 38 contact and depress spring loaded metal buttons 72, 74, 76 and 78 respectively.

While plug 20 is pressed inward in opening 52, and the spring loaded buttons are depressed, socket 50 is rotated 86 on axis 94 until radially extending annular hats 44 move under slot shoulders 82 and then, simultaneously with shafts 43 moving into slot extensions 80, move under slot shoulders 83.

When shafts 43 of the plug are in slot extensions 80 of the socket, axial grooves 45 and 47 in wall 42 of the plug are adjacent to, spaced from and preferably extend around to each side of butons 76 and 78 respectively, plug shoulder 40 is adjacent to and facing socket shoulder 62, and plug shoulder 64 is adjacent to and facing socket shoulder 68. Outer wall 66 continuously surrounds wall 42 and shoulder 40, presenting in combination with shoulder 40 a closed box to thin foreign objects from access to terminals 36, 38 and shafts 43 at the interfaces between parts of the plug and socket.

When pressure pushing the plug into the socket is relaxed, hats 44 shift axially outward under spring-induced pressure of the buttons, and the hats catch on shoulder 83 which is recessed from shoulder 82, so that the socket cannot be rotated back 87 to a position where the hats could exit from openings 90 unless the plug and socket are pressed together again.

Tubular passageways 84 slidingly hold, spring loaded buttons 72 and 74. Tubular passageways 88, each topped by a semicircular in cross section elongated groove 92 slidingly hold spring loaded buttons, 76 and 78 which are biased upward against shoulders 63. Buttons 72, 74 76 and 78 are urged upward respectively from base 100 top 102 by springs 73, 75, 77, and 79.

Ceramic base 100 of socket 50 mounts on bottom 96 of body 56 portion of socket 50.

Power delivery wires 120 extend through holes 124 in base 100, one hole 124 for each wire, and are soldered, one each, to the bottoms of springs 73, 75, 77, and 79. Then the buttons and their respective springs are guided into their respective passages in body 56 and base 100 is mounted on body 56.

Ceramic pin extension 104 of body 56 is received in hole 106 in base 100 and extends below shoulder 110 in hole 112 when base 100 is mounted on body 56. Spring lock washer 108 is slipped on the end of pin 104 to hold the base on body 56. Preferably base 100 is glued to body 56. Glue applied to top 102 sets in contact with bottom 96 when the base is mounted on the body and is held on the body by the washer.

Axis 94 of assembled plug 20, body 56 and base 100 is parallel to axis 130 of mercury vapor ultraviolet lamp 128 envelope 28.

Lamp 128 is mounted in ultraviolet transparent quartz cylindrical tube 134 which is water tight sealed by compression ring 138 and compression nut 140 to tank 142 wall 144. Water to be purified by ultraviolet radiation passes through inlet port 150, across lamp and tube assembly 154 comprising lamp 128, plug 20, socket 50 and tube 134, across similar lamp and tube assembly 158, and out of the tank by way of outlet port 164. Rings 182 space, 360 degrees around quartz envelope 28, lamp 128 from quartz tube 134.

Figure 11:
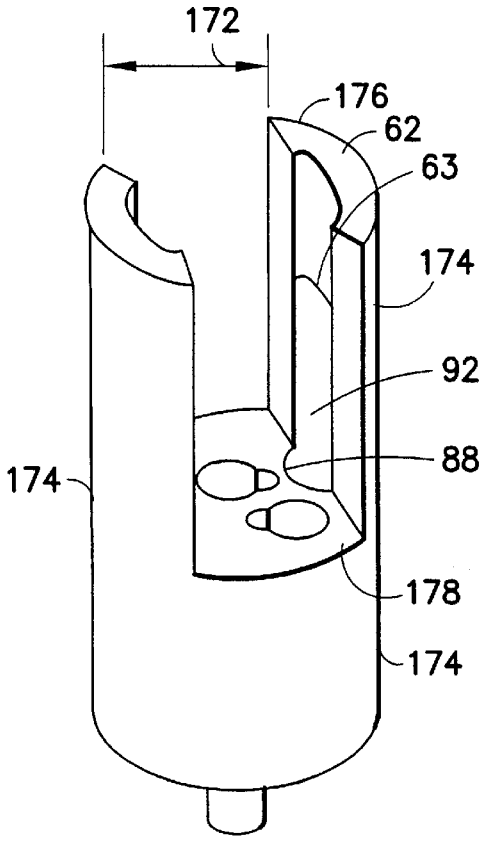
FIG. 11 is a perspective view of another socket of the invention.
Figure 10:
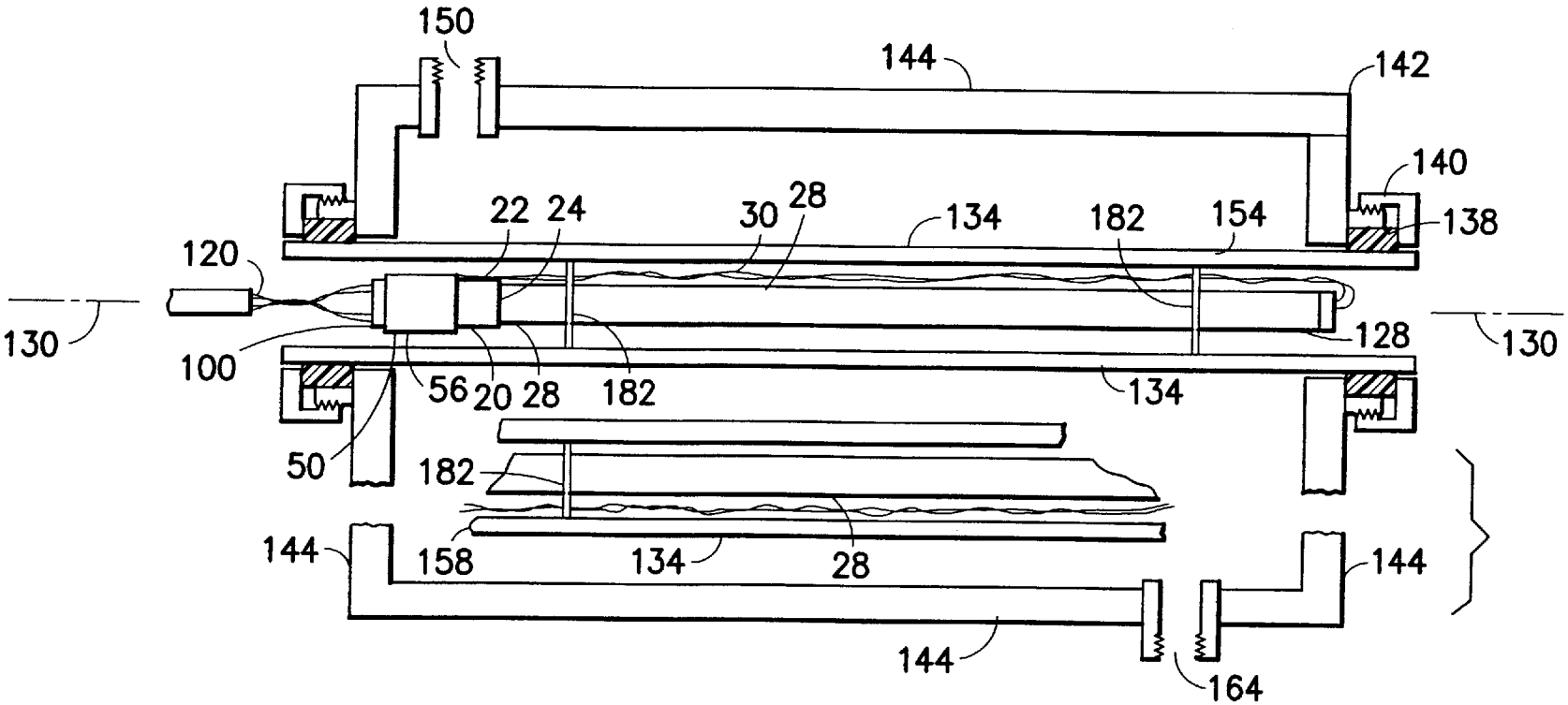
FIG. 10 is a schematic view of a water purification tank containing two ultraviolet transparent tubes, each tube containing an ultraviolet lamp, having a connector assembly of the invention.

Referring to FIG. 11, outer wall 174 of socket 176 is discontinuous 172 above shoulder 178. Otherwise, socket 176 is similar to socket 50, and receives plug 20 and a base 100 as does socket 50.

Although the present invention has been described with respect to details of certain embodiments thereof, it is not intended that such details be limitations upon the scope of the invention. It will be obvious to those skilled in the art that various modifications and substitutions may be made without departing from the spirit and scope of the invention as set forth in the following claims.

What is claimed is:

1. A high voltage connector assembly for a lamp comprising a sealed envelope having a first end and electrical conductors extending from said envelope, said connector assembly comprising:

a plug and a socket, said plug comprising:

a first electrically non conductive body comprising a front, a back and a first axis extending through the front and the back, a lateral first shoulder, spaced from the front of said first body, a first electrically conductive terminal, extending backward axially from said first shoulder, spaced from said first axis, having a front end adapted for electrical connection to an electrical conductor of said lamp, and a back end, a first wall extending backward axially from said first shoulder adjacent to and spaced from said first terminal, a second electrically conductive terminal, extending backward axially from said first wall backward of said first terminal, spaced from said first axis, having a front end adapted for electrical connection to an electrical conductor of said lamp, a back end, and a lateral protrusion on the back end of said second terminal, said socket comprising:

a second electrically non conductive body comprising a front, a back and a second axis extending through the front and the back, a lateral third shoulder, spaced from the back of said second body, a first passageway in the back of said second body extending axially through said third shoulder spaced from said second axis, a first electrical contact mounted in said first passageway axially movable comprising means for urging said first electrical contact toward the front of said second body, a second passageway in the back of said second body extending axially through said third shoulder, spaced from said second axis and from said first passageway, comprising a lateral fourth shoulder behind said third shoulder, a second electrical contact mounted in said second passageway axially movable comprising means for urging said second electrical contact toward the front of said second body, said first terminal, second terminal, first passageway and second passageway being so configured that when said plug is placed on said socket with the first and second axes in alignment, said first terminal axially on and axially depressing said first electrical contact, said second terminal axially on and axially depressing said second electrical contact, said protrusion can be rotated around said first axis under said fourth shoulder.

2. A high voltage connector assembly for a lamp comprising a sealed envelope having a first end and electrical conductors extending from said envelope, said connector assembly comprising:

a plug and a socket, said plug comprising:

a first electrically non conductive body comprising a front, a back and a first axis extending through the front and the back, a lateral first shoulder. spaced from the front of said first body, a first electrically conductive terminal, extending backward axially from said first shoulder, spaced from said first axis, having a front end adapted for electrical connection to an electrical conductor of said lamp, and a back end, a first wall extending backward axially from said first shoulder adjacent to and spaced from said first terminal, a lateral second shoulder on said first wall, spaced back from the back end of said first terminal, a second electrically conductive terminal, extending backward axially from said second shoulder, spaced from said first axis and from said first terminal, having a front end adapted for electrical connection to an electrical conductor of said lamp, a back end, and a lateral protrusion on the back end of said second terminal, said socket comprising:

a second electrically non conductive body comprising a front, a back and a second axis extending through the front and the back, a lateral third shoulder, spaced from the back of said second body, a first passageway in the back of said second body extending axially through said third shoulder spaced from said second axis, a first electrical contact slidably mounted in said first passageway, first means in said first passageway for urging said first electrical contact toward the front of said second body, a second passageway in the back of said second body extending axially through said third shoulder, spaced from said second axis and from said first passageway, comprising a lateral fourth shoulder behind said third shoulder, a second electrical contact slidably mounted in said second passageway, second means in said second passageway for urging said second electrical contact toward the front of said second body, said first terminal, second terminal, first passageway and second passageway being so configured that when said plug is placed on said. socket with the first and second axes in alignment, said first terminal axially on and axially depressing said first electrical contact, said second terminal axially on and axially depressing said second electrical contact, said protrusion can be rotated around said first axis under said fourth shoulder.

3. The connector assembly of claim 2 further comprising:

a lateral fifth shoulder behind said third shoulder, closer to said third shoulder than said fourth shoulder, configured for receiving said protrusion.

4. The connector assembly of claim 2 further comprising:

an electrically non conductive plate extending over the first and second passageways, means for attaching said plate to the back of said second body, means, extending through said plate, for electrically connecting to the first and second means for urging.

5. A high voltage connector assembly for a lamp comprising a sealed envelope having a first end and electrical conductors extending from said envelope, said connector assembly comprising:

a plug and a socket, said plug comprising:

a first electrically non conductive body comprising a front, a back and a first axis extending through the front and the back, a lateral first shoulder, spaced from the front of said first body, a first electrically conductive terminal, extending backward axially from said first shoulder, spaced from said first axis, having a front end adapted for electrical connection to an electrical conductor of said lamp, and a back end, a first wall extending backward axially from said first shoulder adjacent to and spaced from said first terminal, a lateral second shoulder on said first wall, spaced back from the back end of said first terminal, a second electrically conductive terminal, extending axially from said second shoulder, spaced from said first axis and from said first terminal, having a front end adapted for electrical connection to an electrical conductor of said lamp, a back end, and a lateral protrusion on the back end of said second terminal, said socket comprising:

a second electrically non conductive body comprising a front, a back and a second axis extending through the front and the back, a lateral third shoulder, spaced from the back of said second body, a second wall extending forward axially from said third shoulder, spaced from said second axis, a first passageway in the back of said second body extending axially through said third shoulder spaced from said second axis, a wall of said first passageway extending from said third shoulder in a groove in said second wall axially along said second wall, a first electrical contact slidably mounted in said first passageway and said groove, first means in said first passageway for urging said first electrical contact toward the front of said second body, a second passageway in the back of said second body extending axially through said third shoulder, spaced from said second axis and from said first passageway, comprising a lateral fourth shoulder behind said third shoulder, a second electrical contact slidably mounted in said second passageway, second means in said second passageway for urging said second electrical contact toward the front of said second body, said first terminal, second terminal, first passageway and second passageway being so configured that when said plug is placed on said socket with the first and second axes in alignment, said first terminal axially on and axially depressing said first electrical contact, said second terminal axially on and axially depressing said second electrical contact, said protrusion can be rotated around said first axis under said fourth shoulder.

6. The connector assembly of claim 5 further comprising:

a lateral fifth shoulder behind said third shoulder, closer to said third shoulder than said fourth shoulder, configured for receiving said protrusion.

7. The connector assembly of claim 5 further comprising:

an electrically non conductive plate extending over the first and second passageways, means for attaching said plate to the back of said second body, means, extending through said plate, for electrically connecting to the first and second means for urging.

8. A high voltage connector assembly for a gas discharge tube comprising a sealed gas discharge envelope having a first end and electrical conductors extending from said envelope, said connector assembly comprising:

a plug and a socket, said plug comprising:

a first electrically non conductive body comprising a front, a back and a first axis extending through the front and the back, a first opening in the front configured for receiving the first end of said envelope, a lateral first shoulder, spaced from the front of said first body, a first electrically conductive terminal post, extending backward axially from said first shoulder, spaced from said first axis, having a front end adapted for electrical connection to an electrical conductor of said gas discharge tube when the first end of said envelope is in said first Opening, and a back end, a first wall extending backward axially from said first shoulder adjacent to and spaced from said first terminal post, a lateral second shoulder on said first wall, spaced back from the back end of said first terminal post, a second electrically conductive terminal post, extending axially from said second shoulder, spaced from said first axis and from said first post, having a front end adapted for electrical connection to an electrical conductor of said gas discharge tube when the first end of said envelope is in said opening, a back end, and a lateral protrusion on the back end of said second terminal post, said socket comprising:

a second electrically non conductive body comprising a front, a back and a second axis extending through the front and the back, a lateral third shoulder, spaced from the back of said second body, a second wall extending axially forward from said third shoulder, spaced from said second axis, a first passageway in the back of said second body extending axially through said third shoulder spaced from said second axis, a wall of said first passageway extending from said third shoulder in a groove in said second wall axially along said second wall, a first electrical contact slidably mounted in said first passageway and said groove, first means in said first passageway for urging said first electrical contact toward the front of said second body, a second passageway in the back of said second body extending axially through said third shoulder, spaced from said second axis and from said first passageway, comprising a lateral fourth shoulder behind said third shoulder, a second electrical contact slidably mounted in said second passageway, second means in said second passageway for urging said second electrical contact toward the front of said second body, said first terminal post, second terminal post, first passageway and second passageway being so configured that when said plug is placed on said socket with the first and second axes in alignment, said first post axially on and axially depressing said first electrical contact, said second post axially on and axially depressing said second electrical contact, said protrusion can be rotated around said first axis under said fourth shoulder.

9. A high voltage connector assembly for a lamp comprising a sealed envelope having a first end and electrical conductors extending from said envelope, said connector assembly comprising:

a plug and a socket, said plug comprising:

a first electrically non conductive body comprising a front, a back and a first axis extending through the front and the back, a first wall on said body, extending axially backward, having a back end, a first pair of electrically conductive terminals on opposite sides of said first wall, each terminal of said first pair being spaced from said first wall and from said first axis, extending from said body axially backward, having a back end forward of the back end of said first wall, and adapted for electrical connection to the lamp, a second pair of electrically conductive terminals, each terminal of said second pair extending from said first wall, being spaced backward of the back ends of the first pair, spaced from said first axis, comprising a lateral protrusion spaced from said first wall, and adapted for electrical connection to the lamp, said socket comprising:

a second electrically non conductive body comprising a front, a back and a second axis extending through the front and the back, four axial passageways through said second body, each passageway of the four passageways comprising a contact mounted in the passageway axially movable comprising means for urging the contact toward the front of said body, said first pair of terminals, second pair of terminals, and four axial passageways being so configured that when said plug is placed on said socket with the first and second axes in alignment, each of the terminals axially on and axially depressing one of the contacts, at least one of said protrusions can be rotated around said first axis under a shoulder adjacent to one of the passageways.

10. In a liquid purification apparatus comprising an ultraviolet light transparent tube having a length and a diameter, that is mounted in a container comprising means for passing liquid by the tube for radiating the liquid with ultraviolet light that emanates from the tube, an ultraviolet lamp mounted in said tube said ultraviolet lamp comprising a sealed gas discharge envelope having a first end and electrical conductors extending from said envelope, a connector assembly comprising:

a plug and a socket, said plug comprising:

a first electrically non conductive body comprising a front, a back and a first axis extending through the front and the back, being smaller in diameter than said tube, a lateral first shoulder, spaced from the front of said first body, a first electrically conductive terminal, extending backward axially from said first shoulder, spaced from said first axis, having a back end, and a front end electrically connected to a conductor of said lamp, a first wall extending backward axially from said first shoulder adjacent to and spaced from said first terminal, a second electrically conductive terminal, extending backward axially from said first wall backward of said first terminal, spaced from said first axis, having a back end, and a front end electrically connected to another conductor of said lamp, and a lateral protrusion on the back end of said second terminal, said socket comprising:

a second electrically non conductive body comprising a front, a back and a second axis extending through the front and the back, being smaller in diameter than said tube, a lateral third shoulder, spaced from the back of said second body, a first passageway in the back of said second body extending axially through said third shoulder spaced from said second axis, a first electrical contact mounted in said first passageway axially movable comprising means for urging said first electrical contact toward the front of said second body, a second passageway in the back of said second body extending axially through said third shoulder, spaced from said second axis and from said first passageway, comprising a lateral fourth shoulder behind said third shoulder, a second electrical contact mounted in said second passageway axially movable comprising means for urging said second electrical contact toward the front of said second body, said first terminal, second terminal, first passageway and second passageway being so configured that when said plug is placed on said socket with the first and second axes in alignment, said first terminal axially on and axially depressing said first electrical contact, said second terminal axially on and axially depressing said second electrical contact, said protrusion can be rotated around said first axis under said fourth shoulder.

* * * * *

UNITED STATES PATENT AND TRADEMARK OFFICE

CERTIFICATE OF CORRECTION

PATENT NO. : 6,634,902 B1
DATED : October 21, 2003
INVENTOR(S) : Arpad L. Pirovic It is certified that error appears in the above-identified patent and that said Letters Patent is hereby corrected as shown below:

Title page,
Below "*Primary Examiner* - Gary Paumen", insert:
-- *Attorney, Agent, or Firm* - Robert A. Seemann --

Column 8,
Line 37, replace "Opening" with -- opening --.

Signed and Sealed this

Second Day of March, 2004

JON W. DUDAS
*Acting Director of the United States Patent and Trademark Office*